US009615996B2

(12) United States Patent
Brandenburger et al.

(10) Patent No.: US 9,615,996 B2
(45) **Date of Patent: *Apr. 11, 2017**

(54) CLOSURE CAP FOR RECEPTACLES FOR RECEIVING MEDICAL LIQUIDS AND RECEPTACLE FOR RECEIVING MEDICAL LIQUIDS

(71) Applicant: Fresenius Kabi Deutschland GmbH, Bad Homburg (DE)

(72) Inventors: Torsten Brandenburger, Reichelsheim (DE); Gerhard Greier, Friedrichsdorf (DE); Ismael Rahimy, Friedberg (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 564 days.

This patent is subject to a terminal disclaimer.

(21) Appl. No.: 14/082,312

(22) Filed: Nov. 18, 2013

(65) Prior Publication Data

US 2014/0076839 A1 Mar. 20, 2014

Related U.S. Application Data

(63) Continuation-in-part of application No. 13/133,674, filed as application No. PCT/EP2009/008622 on Dec. 3, 2009, now Pat. No. 8,585,674.

(30) Foreign Application Priority Data

Dec. 9, 2008 (DE) ..... 10 2008 060 864

(51) Int. Cl.
*A61J 1/14* (2006.01)
*A61J 1/18* (2006.01)
(Continued)

(52) U.S. Cl.
CPC ..... *A61J 1/1406* (2013.01); *A61J 1/1418* (2015.05); *A61J 1/1481* (2015.05); *A61J 1/1487* (2015.05);
(Continued)

(58) Field of Classification Search
CPC ..... A61J 1/1406; A61J 1/1412; A61J 1/1418; A61J 1/1431; A61J 1/1468; A61J 1/1475;
(Continued)

(56) References Cited

U.S. PATENT DOCUMENTS 2,442,983 A 6/1948 Nesset
4,501,372 A 2/1985 Hansen
(Continued)

FOREIGN PATENT DOCUMENTS

DE 8308416 6/1983
DE WO 2006042579 A1 * 4/2006 ..... B65D 51/002
(Continued)

OTHER PUBLICATIONS

English machine translation of DE 10 2007 005 407 A1, Accessed electronically by USPTO on Apr. 2, 2016 from Google Patents.*

*Primary Examiner* — Tatyana Zalukaeva
*Assistant Examiner* — Benjamin Klein
(74) *Attorney, Agent, or Firm* — Occhiuti & Rohlicek LLP

(57) ABSTRACT

The invention relates to a closure cap (1) for receptacles for receiving medical liquids, in particular receptacles filled with infusion solutions, transfusion solutions or liquids for enteral nutrition. The invention further relates to a receptacle (40) for receiving medical liquids, in particular a bottle, comprising such a closure cap. The closure cap (1) according to the invention is characterized by two injection parts (6 and 7) arranged separately from one another, each for injecting an additive. One injection part (6) serves to inject
(Continued)

an additive with an injection syringe that has a needle (cannula), while the other injection part (7) serves to inject an additive with a needle-less injection syringe.

19 Claims, 7 Drawing Sheets

(51) Int. Cl.
*B65D 41/50* (2006.01)
*B65D 47/36* (2006.01)
*B65D 51/00* (2006.01)

(52) U.S. Cl.
CPC ..... *A61J 1/18* (2013.01); *B65D 41/50* (2013.01); *B65D 47/36* (2013.01); *B65D 51/002* (2013.01); *A61J 1/1431* (2015.05); *A61J 1/1468* (2015.05)

(58) Field of Classification Search
CPC ..... A61J 1/1481; A61J 1/1487; A61J 1/18; B65D 41/50; B65D 47/36
See application file for complete search history.

(56) References Cited

U.S. PATENT DOCUMENTS

| | | | | |
|---|---|---|---|---|
| 4,951,845 | A | 8/1990 | Pezzoli et al. | |
| 5,125,522 | A | 6/1992 | Pezzoli et al. | |
| 5,678,713 | A | 10/1997 | Derksen | |
| 7,488,311 | B2 | 2/2009 | Domkowski et al. | |
| 8,211,081 | B2 * | 7/2012 | Brandenburger .... | B65D 51/002 222/129 |
| 2008/0172022 | A1 * | 7/2008 | Poo ..... | A61J 1/10 604/408 |
| 2010/0059474 | A1 * | 3/2010 | Brandenburger ..... | A61J 1/1412 215/316 |
| 2011/0166532 | A1 * | 7/2011 | Brandenburger ..... | A61J 1/2096 604/201 |

FOREIGN PATENT DOCUMENTS

| | | |
|---|---|---|
| DE | 102007005407 | 8/2008 |
| WO | 2006/042579 | 4/2006 |
| WO | 2006/115969 | 11/2006 |
| WO | 2008/095665 | 8/2008 |

* cited by examiner

CLOSURE CAP FOR RECEPTACLES FOR RECEIVING MEDICAL LIQUIDS AND RECEPTACLE FOR RECEIVING MEDICAL LIQUIDS

CROSS REFERENCE TO RELATED APPLICATIONS

This application is a continuation-in-part of U.S. application Ser. No. 13/133,674, filed Jun. 9, 2011, which is a National Stage of International Application No. PCT/EP2009/008622, filed on Dec. 3, 2009, which claims the priority of German Patent Application No. 10 2008 060 864.5, filed on Dec. 9, 2008. The contents of both applications are hereby incorporated by reference in their entirety.

FIELD OF DISCLOSURE

The invention relates to a closure cap for receptacles for receiving medical liquids, in particular for receptacles filled with infusion or transfusion solutions or liquids for enteral nutrition. The invention further relates to a receptacle for receiving medical liquids, in particular a bottle, with a closure cap of this kind.

BACKGROUND

A method known as a blow-fill-seal method (BFS method) is known in which receptacles, for example bottles made of extruded PE or PP, are blown in a sterile and pyrogen-free state into a desired shape in one operation and, directly after cooling, are filled aseptically with a sterile filler and hermetically sealed. The receptacles, in particular bottles, produced by the blow-fill-seal method are also referred to as BFS receptacles.

If the known BFS receptacles are used to receive sterile medical liquids, for example infusion solutions, the receptacles require a closure cap that allows the infusion solution to be transferred to the patient by means of an infusion appliance. The addition of medicaments to the infusion solution should likewise be possible.

WO 2008/095665 A1 discloses a closure cap for a receptacle for receiving medical liquids, in particular a BFS bottle. The known closure cap has a lid part and an edge part, with an injection part arranged in the lid part. The injection part has an outwardly directed connector part, with a conical recess that sealingly receives the conical stem of a needleless injection syringe, and an inwardly directed closure part, in which a self-sealing membrane is fitted. In addition to the injection part, the closure cap also has a withdrawal part for withdrawing a medical liquid using a spike.

A closure cap, which has a withdrawal part for withdrawing liquid and also an injection part for injecting an additive, is known from WO 2006/042579 A1.

The closure caps known from WO 2008/095665 A1 and from WO 2006/042579 A1 are characterized in that both closure caps have only one withdrawal part and one injection part. Both closure caps have proven effective in practice. The injection part permits subsequent injection of an additive or the injection of several additives in succession into the medical liquid. The injection part is closed in a sterile manner by a break-off part. A disadvantage is that, although the receptacle is still tightly sealed by the self-sealing membrane after the break-off part of the injection part has been broken off, the connector part of the injection part is exposed to a non-sterile environment. Therefore, there is in principle a danger of contamination of the injection part unprotected on the outside, and this proves disadvantageous if a further additive is to be injected at the injection part.

Closure caps for receptacles containing solutions for enteral nutrition are also known from U.S. Pat. No. 5,125,522 and U.S. Pat. No. 4,951,845. These closure caps only have one withdrawal site. In addition to the withdrawal site, the known closure caps have a vent opening, which is closed with a sterile filter.

WO 2006/115969 A3 describes a closure cap designed for a receptacle and having a large number of openings of different designs, for example round or star-shaped openings. All of the openings are distributed peripherally about the center of the closure cap.

Conical connectors with a conical stem and a conical sleeve whose conical surfaces are standardized are known in medical technology for connecting medical appliances. The unlockable cone connections with standardized cone surfaces are known as Luer connectors, and the lockable cone connections are known as Luer lock connectors. Luer syringes without screw connections and Luer lock syringes with screw connections are thus also known.

It is an object of the invention to make available a closure cap for receptacles for receiving medical liquids, in particular for receptacles filled with infusion or transfusion solutions or liquids for enteral nutrition, which closure cap is particularly easy to handle and can be used universally. It is also an object of the invention to make available a receptacle for receiving medical liquids, in particular a bottle, which is easy to handle and can be used universally.

According to the invention, these objects are achieved by the features specified in claims 1 and 17. Preferred embodiments of the invention are set forth in the dependent claims.

The closure cap according to the invention is characterized by two injection parts arranged separately from each other and each designed for injection of an additive. One injection part is used for injection of an additive using a needleless syringe, while the other injection part is used for injection of an additive using an injection syringe that has a needle. It is therefore possible to inject different additives into the medical liquid contained in the receptacle using a needleless injection syringe and also using an injection syringe with needle. The closure cap according to the invention can thus be used universally.

If, for example, a first additive has been injected via the first injection part, a second additive can be injected via the second injection part. Both injection parts are preferably closed tightly with a break-off part. If the break-off part of one injection part is broken off, the other injection part remains protected by the break-off part that has not been broken off. This has the advantage that the as yet unused injection part cannot be contaminated.

In a preferred embodiment, the closure cap has a lid part and an edge part, wherein the lid part has an inner portion and an outer portion which protrudes outward from the inner portion. The first and second injection parts and the withdrawal part are preferably arranged on the outer outwardly protruding portion of the lid part. Thus, the injection site and the withdrawal site extend forward such that the injection sites and the withdrawal site on the closure cap are easily accessible.

In a preferred embodiment, the first and second injection parts and the withdrawal part are arranged preferably lying next to one another in a row on the outer portion of the lid part. The outer portion of the lid part should extend as far as possible across the entire width of the lid part. In this way, sufficient space is made available for the arrangement of the injection parts and of the withdrawal part.

In an alternative embodiment, the injection parts and the withdrawal part are arranged offset in relation to one another on the outer portion of the lid part. In this alternative embodiment, the outwardly protruding portion of the lid part preferably has a substantially rectangular shape, such that sufficient space is made available for the injection parts and the withdrawal part.

The break-off parts for closing the injection parts and the withdrawal part preferably have lateral grip tabs, which preferably extend across the outer portion of the lid part. In this way, the grip tabs can be easily gripped from the side.

The injection part for the needleless injection syringe has an outwardly directed connector part, with a recess for receiving the conical stem of the syringe, and an inwardly directed closure part, in which a self-sealing membrane is arranged. The outwardly directed connector part of the first injection part preferably has an outer thread, such that a known Luer lock syringe can be attached to the connector part. However, it is also possible that the connector part of the injection part has no outer thread, such that only the attachment of a known Luer syringe is possible.

In one embodiment a hollow body with a point is arranged in the recess of the connector part of the injection part which is designed for injecting an additive into the medical liquid using a needleless injection syringe, wherein the membrane and the hollow body are arranged in the recess of the connecting part in such a manner that the membrane is pierced when the syringe is connected to the connecting part, wherein the membrane is arranged above the hollow body in the recess of the connecting part and therefore, when the syringe is connected to the connecting part, the membrane is pressed by the syringe onto the point of the hollow body. In one embodiment the hollow body is designed as a cannula with a ground section. In a further embodiment the hollow body in the recess of the connecting part is fastened to a disk-shaped body which preferably has openings, preferably for ventilation purposes. These openings in the disk-shaped body are for instance bores which can be distributed circumferentially around the hollow body.

The receptacle according to the invention, in particular an infusion or transfusion receptacle or a receptacle for receiving a solution for enteral nutrition, is preferably designed as a bottle, in particular an SBM (stretch-blow-molding) bottle that is closed with the closure cap according to the invention.

According to one embodiment the closure cap comprises or consists of polypropylene and/or polyethylene. In one further embodiment the membrane comprises or consists of polyisoprene and/or brominebutyl and/or chlorinebutyl.

According to one embodiment the withdrawal part for withdrawing the medical liquid using a spike is adapted to receive a spike having a diameter in the range of approximately at least 5 mm to approximately 6.5 mm. In another embodiment the injection part for injecting an additive into the medical liquid using a needleless injection syringe is adapted to receive a Luer-Lock syringe having a cone diameter of about 4 mm. In one further embodiment the second injection part designed for injecting an additive into the medical liquid using an injection syringe that has a needle is adapted to receive a needle having a diameter up to about 5 mm. For instance the outer diameter of the closure cap is in the range of 30 mm to 40 mm. For instance the maximum height the closure cap (including the break-off parts) is in the range of 25 mm to 35 mm.

BRIEF DESCRIPTION OF THE DRAWINGS

Two illustrative embodiments of the invention are explained in more detail below with reference to the drawings, in which.

DETAILED DESCRIPTION

Figure 1:
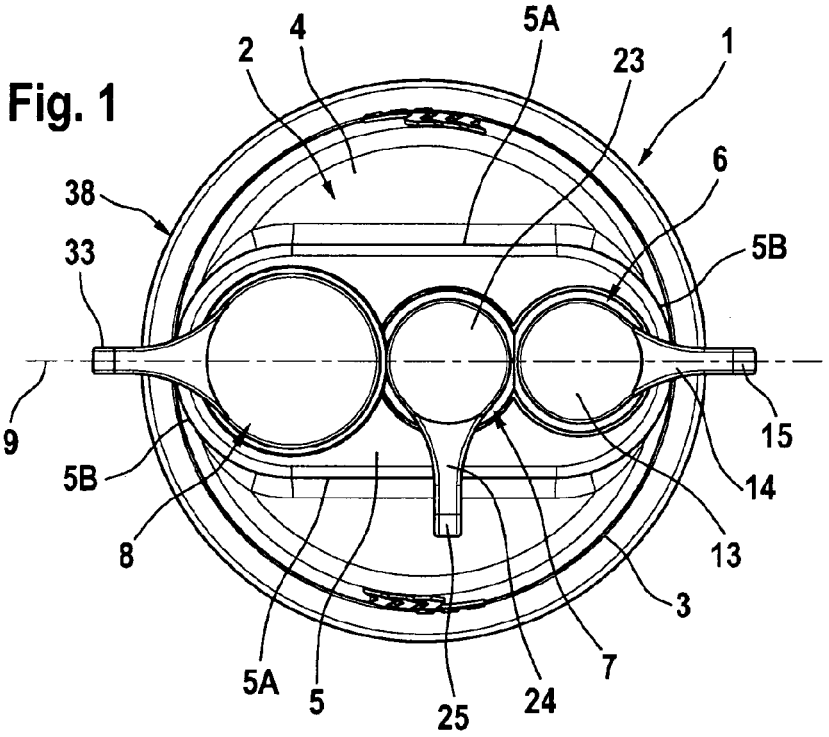
FIG. 1 shows an illustrative embodiment of the closure cap according to the invention in a plan view in which the injection parts and the withdrawal part are arranged in a row.
Figure 2:
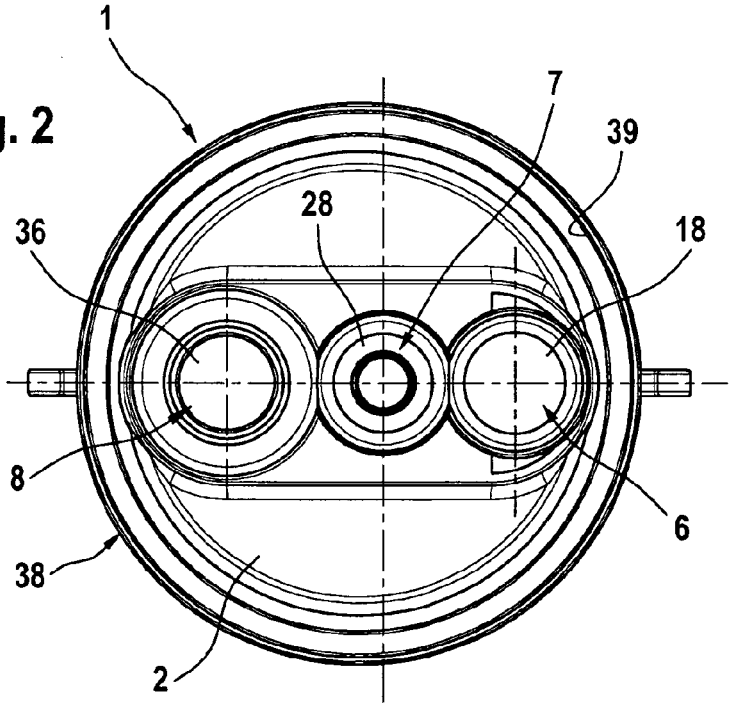
FIG. 2 shows the closure cap from FIG. 1 in a view from underneath.
Figure 3:
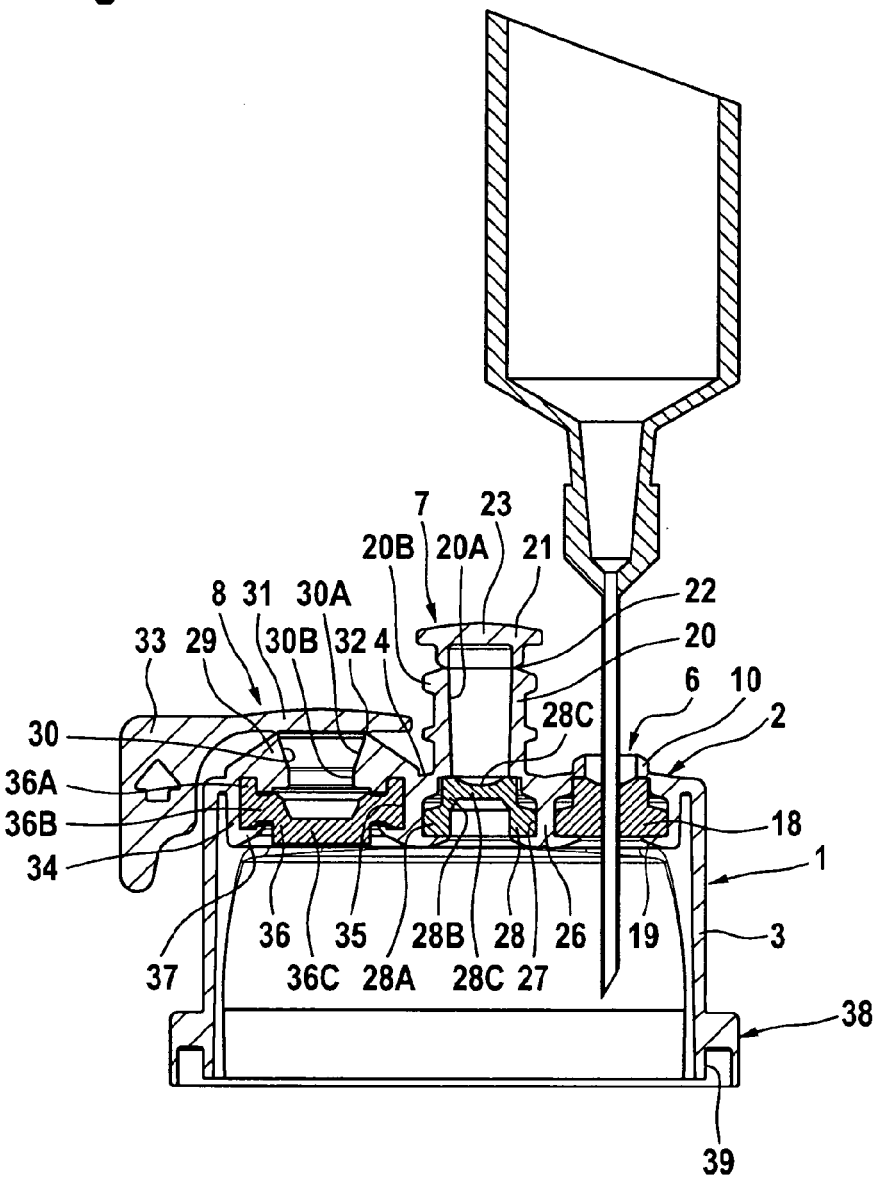
FIG. 3 shows the closure cap from FIG. 1 in a sectional view, wherein the break-off part is broken off from an injection part in order to inject an additive using a syringe that has a needle.
Figure 4:
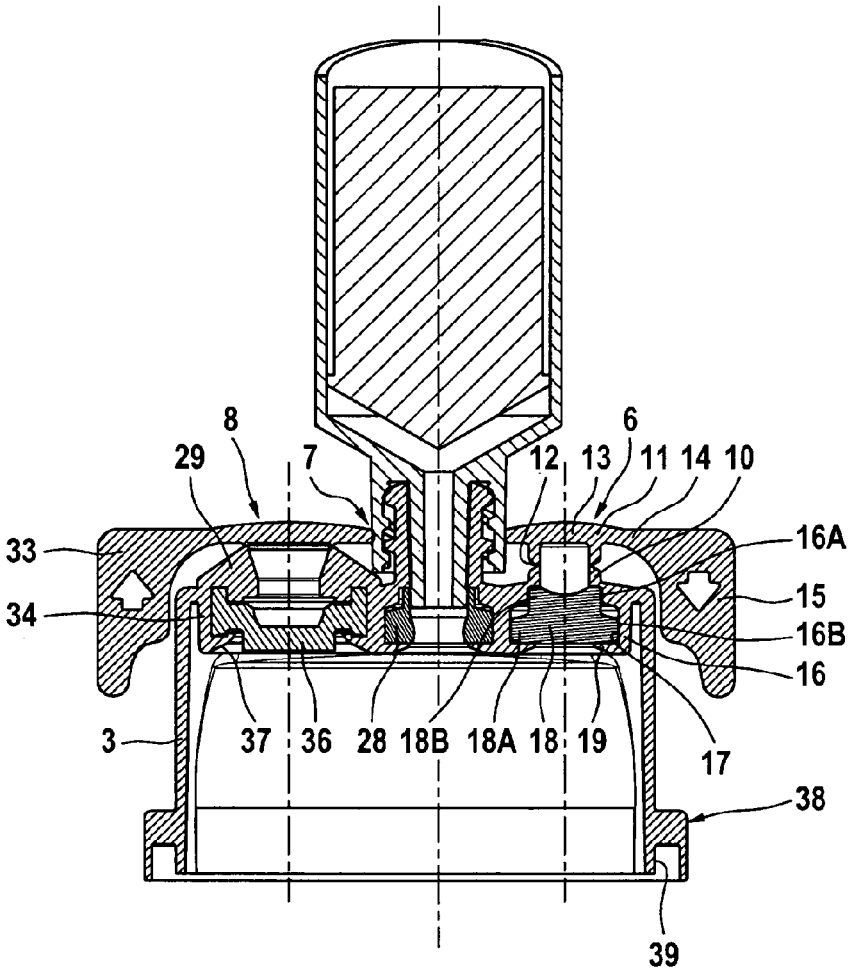
FIG. 4 shows the closure cap from FIG. 1 in a sectional view, wherein the break-off part is broken off from the other injection part in order to inject an additive using a needleless syringe.
Figure 5:
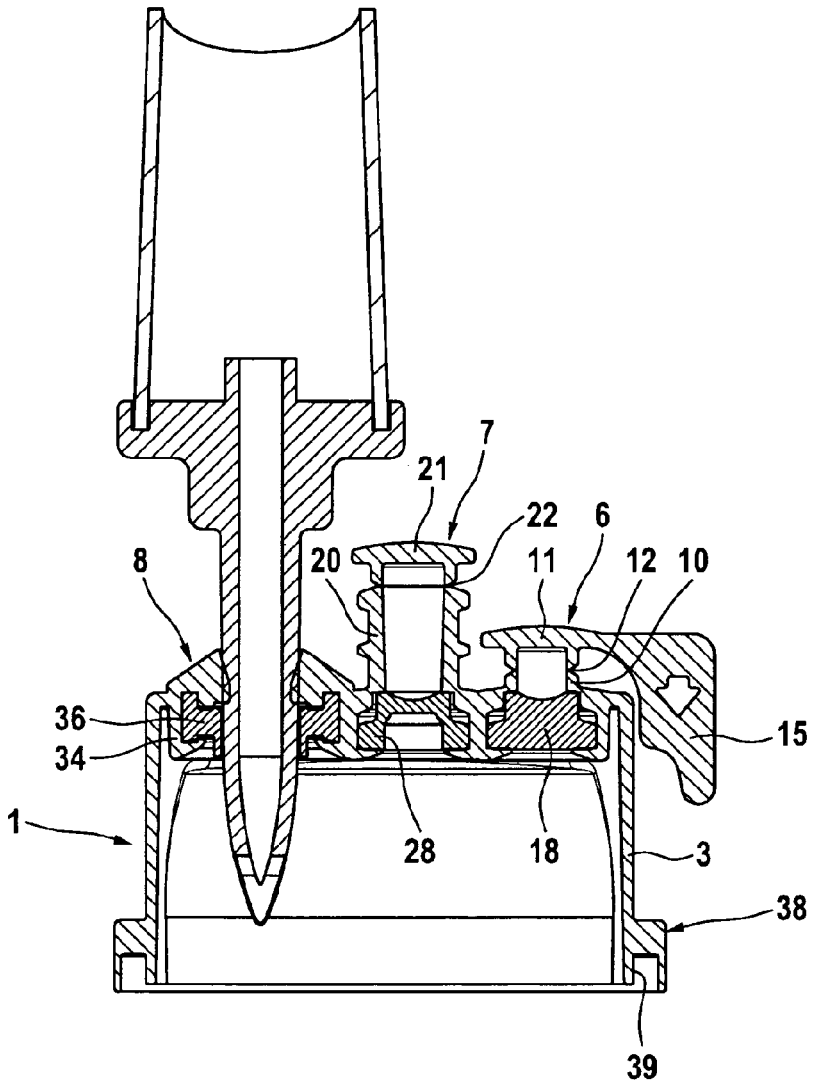
FIG. 5 shows the closure cap from FIG. 1 in a sectional view, wherein the break-off part is broken off from the withdrawal part in order to withdraw liquid using a spike.

FIGS. 1 and 2 show a first illustrative embodiment of the closure cap according to the invention in a plan view and a bottom view, while FIGS. 3 to 5 show the closure cap in sectional views, wherein an additive is injected using an injection syringe or a liquid is withdrawn using a spike. Apart from the pierceable membranes, the closure cap is a one-piece plastic component that can be produced inexpensively in large numbers.

The closure cap 1 has a lid part 2 and an edge part 3. The lid part 2 has a flat inner portion 4, from which an outer portion 5 protrudes outward. The outer portion 5 of the lid part 2 has an elongate shape with two substantially rectilinear portions 5A, which are adjoined at both sides by substantially semicircular portions 5B. The outer portion 4 extends across the whole width of the inner portion 4 of the lid part 2. A first injection part 6, a second injection part 7 and a withdrawal part 8 are located on the top of the outer portion 5 of the lid part 2 in a manner easily accessible to the user. The first injection part 6 is used for injection of an additive using an injection syringe that has a needle (FIG. 3), while the second injection part 7 is used for injection of an additive using a needleless injection syringe (FIG. 4). The withdrawal part 8 is used for withdrawal of liquid using a spike (FIG. 5).

The two injection parts 6 and 7 and the withdrawal part 8 are arranged lying close to one another in a row on the outer portion 5 of the lid part 2. They lie on an axis 9 that corresponds to the longitudinal axis of the outer portion 5 of the lid part 2. The two injection parts 6 and 7, which have a smaller diameter than the withdrawal part 8, are arranged lying closely next to each other, while the withdrawal part 8 lies close to the two injection parts 6, 7.

The two injection parts 6, 7 and the withdrawal part 8 are described below in more detail with reference to FIGS. 3 to 5.

The first injection part 6, arranged on the outer edge of the lid part 2 and designed for injection of an additive using an injection syringe (FIG. 3) that has a needle, comprises an outwardly directed annular shoulder 10, which encloses the injection site. The annular shoulder 10 is closed with a break-off part 11, which adjoins the upper end of the annular portion 10 via an annular break-off zone 12 (FIGS. 4 and 5). The break-off part 11 has a round cap 13, to which a grip tab 15 is adjoined via a narrow web 14, which grip tab 15 extends across the outer portion 5 of the lid part 2 and downward as far as the edge part 3 of the closure cap 1.

From the annular portion 10 of the first injection part 6, a closure part 16 is directed inward and has a recess 17. A pierceable, self-sealing membrane 18 is fitted in the recess 17 of the closure part 16. The membrane 18 is secured with a snap-fit in the recess 16. The recess 16 has an upper cylindrical portion 16A, which adjoins the annular portion 10 of the first injection part 6. The upper cylindrical portion 16A is adjoined by a lower cylindrical portion 16B, which has a greater internal diameter than the upper cylindrical portion 16A. The self-sealing membrane 18 accordingly has a lower cylindrical portion 18A with a greater external diameter, which sits in the lower cylindrical portion 16B of the recess 16. The lower cylindrical portion 18A of the membrane 18 is adjoined by an upper cylindrical portion 18B with a smaller external diameter, which sits snugly in the upper cylindrical portion 16A of the recess 16.

To fix the membrane 18 with a clamping action in the recess 17, the closure part 16 has an inwardly projecting edge 19 at the lower end of the closure part 16 that engages under the membrane 18. The membrane 18 has a flat top and bottom and is not slotted. This means that, when the needle of an injection syringe has been pulled out, the membrane reliably seals again and no liquid escapes.

The second injection part 7, arranged centrally, has an outwardly directed connector part 20 for the connection of a needleless Luer lock syringe (FIG. 4). Otherwise, the second injection part 7 does not differ from the first injection part 6. The connector part 20 of the second injection part has a conical recess 20A, for sealingly receiving the conical stem of the syringe, and an outer thread 20B. The conical recess 20A and the outer thread 20B are designed in such a way that a commercially standard Luer lock syringe can be attached to the connector part.

The connector part 20 is closed with a break-off part 21, which is attached to the upper end of the connector part via an annular break-off zone 22. The break-off part 22 has a round cap 23 which is adjoined, via a narrow web 24, to a lateral grip tab 25, which extends outward across the outer portion 5 of the lid part 2 and as far as the inner portion 4 of the lid part 2.

The second injection part 7 also has a closure part 26, which corresponds to the closure part 16 of the first injection site 6. The closure part 26 of the second injection site again has a recess 27, in which a membrane 28 is fixed with a clamping action. The closure part 26 of the second injection part 7 differs from the closure part of the first injection part 6 in terms of the membrane 28, which has a lower annular portion 28A adjoined, via a central web 28B, to an upper plate-shaped portion 28C, which has a cup-shaped depression 28D. The plate-shaped portion 28C of the membrane 28 is provided with one or more slits, for example being slotted crosswise.

The withdrawal part 8 of the closure cap 1 has an outwardly directed connector part 29 for the attachment of the spike of an infusion appliance (FIG. 5). The connector part 29 has a recess 30 into which the spike of the infusion appliance is inserted. The recess 30 has an upper conical portion 30A and a lower cylindrical portion 30B, wherein the upper conical portion serves to center the spike, and the lower cylindrical portion serves to receive the spike sealingly. The recess 30 of the connector part 29 is closed with a break-off part 31, which is attached to the upper end of the connector part via an annular break-off zone 32. The break-off part 31 again has a lateral grip tab 33 which, like the grip tab of the break-off part of the first injection part, protrudes outward across the outer portion 5 of the lid part 2 and extends as far as the edge part 3 of the closure cap 1.

The withdrawal part 8 has an inwardly protruding closure part 34 with a recess 35, in which once again a pierceable, self-sealing membrane 36 is fixed with a clamping action. The self-sealing membrane 36 of the withdrawal part 8 has an outer annular upper portion 36A, to which a plate-shaped lower portion 36C is adjoined via a central web 36B. The central web 36B of the membrane 36 is held and clamped by an inwardly protruding edge 37 at the lower end of the closure part 34.

At the lower edge of the edge part 3, the closure cap 1 has a bead-shaped edge 38, which has a circumferential groove 39 on the underside. The closure cap can be fitted onto a bottle, wherein the upper edge of the bottle neck engages in the groove 29 of the bead-shaped edge 38 of the closure cap 1.

Figure 8:
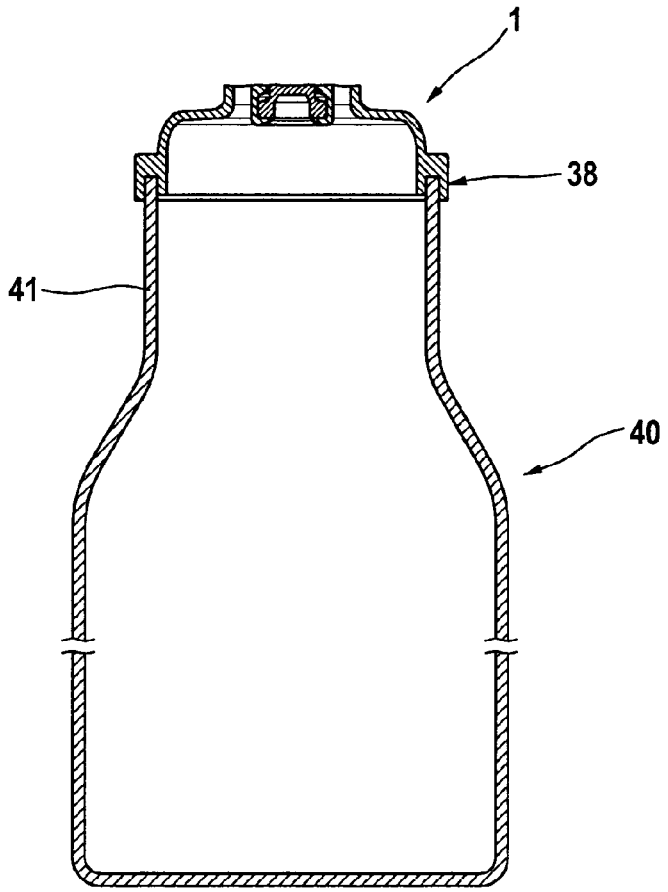
FIG. 8 shows an illustrative embodiment of receptacle according to the invention with a closure cap according to the invention.

FIG. 8 shows a bottle 40, in particular an SMB bottle, which is closed with the closure cap 1 according to the invention. The closure cap 1 sits securely on the bottle neck 41 of the bottle 40, which is filled with an infusion solution for example. Since the bottle neck is not closed in the head area and is instead open, the liquid is in direct contact with the cap. It is therefore possible to inject a medicament using a needleless injection syringe or using an injection syringe with needle. The closure cap can be designed as a screw cap, which is screwed onto the bottle neck of the bottle. However, it is also possible to weld the closure cap to the bottle neck.

The handling of the closure cap 1 is described below.

To withdraw a liquid, for example an infusion solution, the break-off part 31 is broken off from the closure cap 1, such that the membrane 36 of the withdrawal part 8 is exposed. The spike of the infusion appliance is then attached to the connector part 29 of the withdrawal part 8 (FIG. 5). If a medicament is to be injected using an injection syringe with needle, the break-off part 11 of the first injection part 6 is broken off, such that the membrane 18 of the first injection part can be pierced by the needle of the syringe. In doing this, however, the second injection site remains protected by the associated break-off part (FIG. 3). If a medicament is to be injected using a needleless injection syringe (Luer lock syringe), the break-off part 21 of the second injection part 7 is broken off, whereupon the Luer lock syringe can be screwed onto the connector part 20 of the second injection part 7 (FIG. 4).

Figure 6:
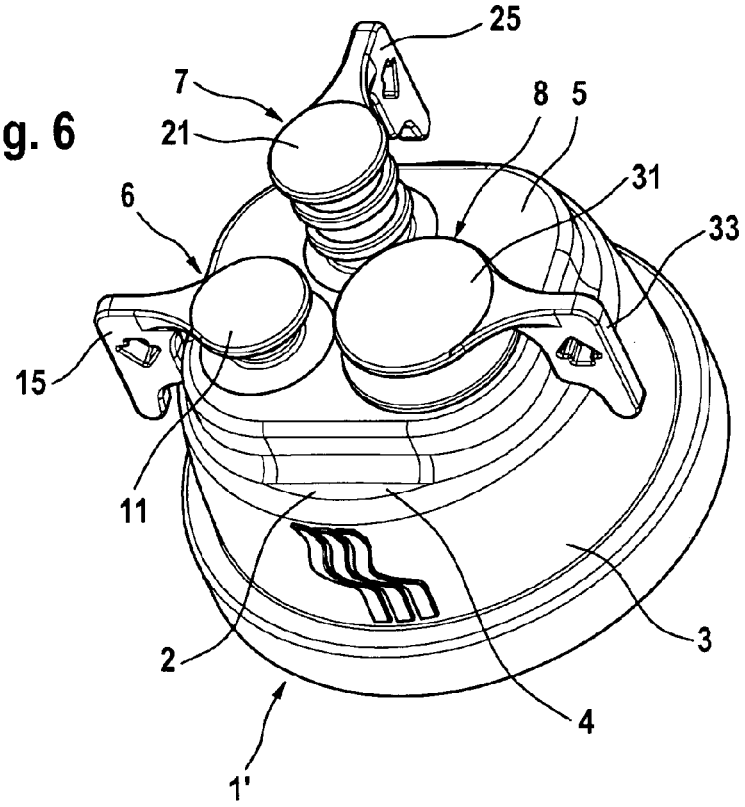
FIG. 6 shows a second illustrative embodiment of the closure cap according to the invention in a view from above, in which the injection parts and the withdrawal part are arranged offset in relation to one another.
Figure 7:
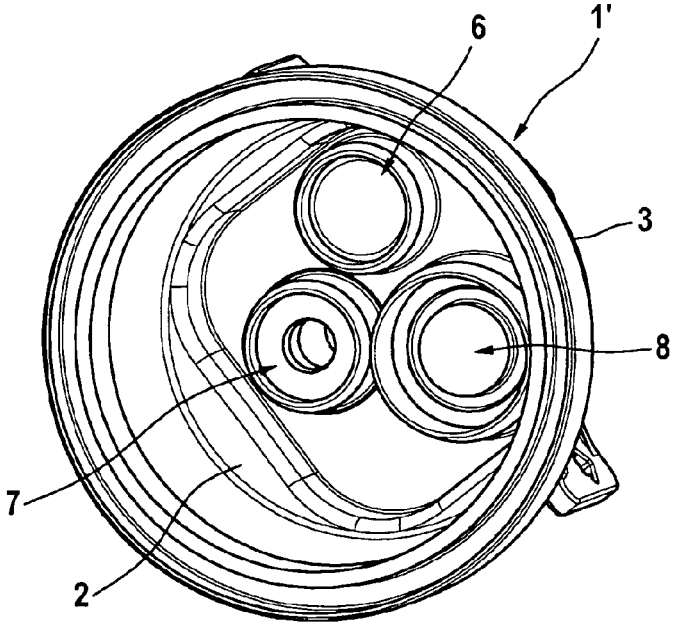
FIG. 7 shows the closure cap from FIG. 6 in a view from underneath.

FIGS. 6 and 7 show an alternative embodiment of the closure cap 1' according to the invention, which differs from the closure cap described with reference to FIGS. 1 to 5 only in terms of the arrangement of the two injection parts and of the withdrawal part on the outer portion of the lid part. Therefore, the same reference signs are also used for the parts that correspond to each other. In the embodiment in FIGS. 6 and 7, the outer portion 5 of the lid part 2 of the closure cap 1' has a substantially rectangular shape with rounded corners. The two injections parts 6, 7 and the withdrawal part 8 are arranged offset in relation to one another on the top of the upper portion 4 of the lid part 2. The first injection part 6 and the withdrawal part 8 lie on one half, and the second injection part 7 on the other half, on the top of the outer portion 5 of the lid part 2. The grip tabs 15, 25, 33 of the injection parts 6, 7 and of the withdrawal part 8 are directed radially outward. They extend outward across the outer portion 5 of the lid part 2 and reach downward as far as the edge part 3 of the closure cap 1. The individual accesses are identified as injection parts or withdrawal part by the upwardly or downwardly directed arrows 42 on the grip tabs 15, 25, 33 of the break-off parts 11, 21, 31.

Figure 9:
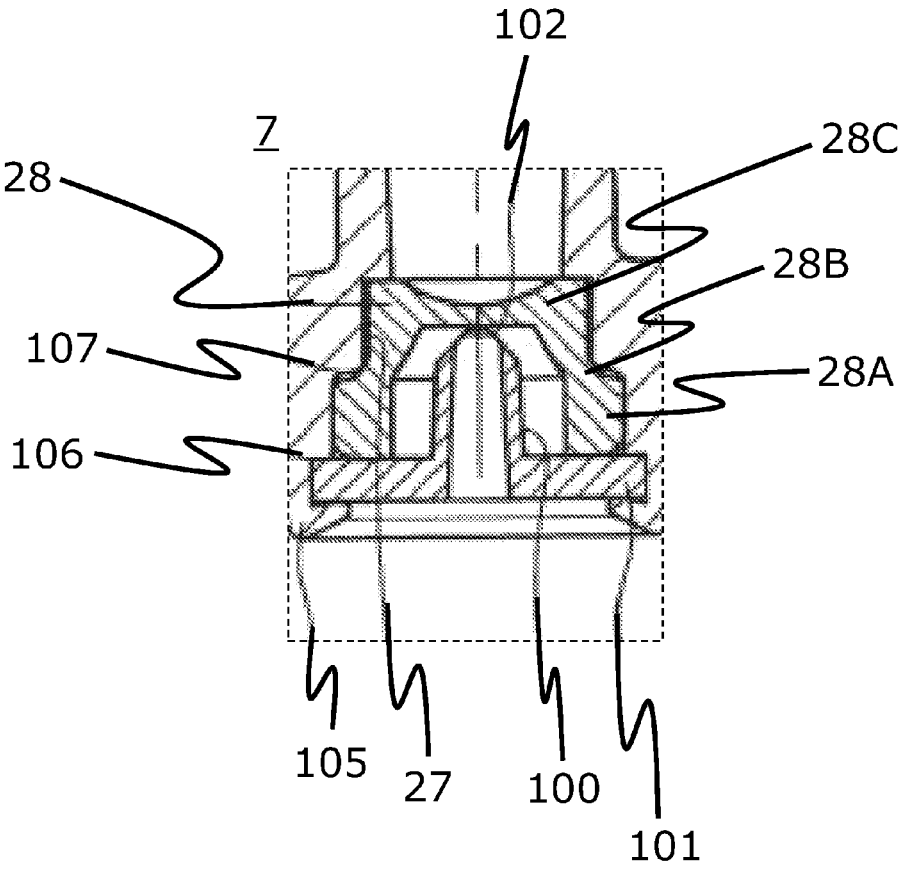
FIG. 9 shows a zoom of an illustrative embodiment of the injection part with a hollow body for piercing the membrane.

Finally FIG. 9 shows a zoom of an illustrative embodiment of the injection part 7 with a hollow body 100 for piercing the membrane 28. In this embodiment upon connection of a syringe to the closure cap, the membrane 28 is pressed onto the point 102 or tip 102 of the hollow body 100 which is arranged below the membrane 28. In this embodiment, the point 102 of the hollow body 100 is not at a distance from the membrane 28 but rather is directly therebelow, preferably in contact with the membrane 28. In a non-shown embodiment the hollow body 100 is at a distance from the membrane 28, i.e. not in contact. Due to the hollow body 100 the reliability of the membrane opening and/or membrane closing is enhanced.

Preferably the hollow body 100 for piercing the membrane 28 upon connection of the syringe is integrally formed on a disk-shaped body 101 which sits together with the membrane 28 in the recess 27 of the lid part 2 of the closure cap. The membrane 28 and the hollow body 100 together with the disk-shaped body 101 are held clamped in the recess 27 by a projecting, encircling extension 105 which engages under the disk-shaped body 101. In this case, the lower portion 28A of the membrane 28 is supported in the recess 27 of the lid part 2 of the closure cap by means of an upper, projecting extension 106 and the disk-shaped body 101 is supported therein by means of a lower, projecting extension 106. However, it is also possible to adhesively bond or to weld the disk-shaped body to the lid part 2 of the closure cap. In one embodiment the projecting, encircling extension 105 is provided as a beading flange.

The invention claimed is:

1. A closure cap for receptacles for receiving medical liquids, said closure cap comprising: a withdraw part for withdrawing the medical liquid using a spike, wherein the withdrawal part has an outwardly directed connector part, with a recess for receiving the spike, and an inwardly directed closure part, in which a self-sealing membrane is arranged with which the recess of the withdrawal part is closed, and a first injection part separate from the withdrawal part and designed for injecting an additive into the medical liquid using a needleless injection syringe, wherein the first injection part has an outwardly directed connector part, with a recess for receiving the conical stem of the syringe, and an inwardly directed closure part, in which a self-sealing membrane is arranged with which the recess of the first injection part is closed, wherein the closure cap has a second injection part separate from the first injection part and designed for injecting an additive into the medical liquid using an injection syringe that has a needle, wherein the second injection part has an inwardly directed closure part, with a recess in which a self-sealing membrane is arranged with which the recess of the closure part is closed wherein the closure cap has a lid having an inner portion and an outer portion protruding outward from the inner portion and wherein the first and second injection parts and the withdrawal part are arranged lying next to one another in a row on the outer portion of the lid part.

2. The closure cap as claimed in claim 1, wherein the connector part of the first injection part has an outer thread.

3. The closure cap as claimed in claim 1, wherein the connector part of the first injection part is closed with a break-off part, which is attached to the connector part of the first injection part via an annular break zone.

4. The closure cap as claimed in claim 3, wherein the break-off part comprises a lateral grip tab that comprises a first portion that extends across the outer portion of the lid part.

5. The closure cap as claimed in claim 4, wherein the lateral grip tab further comprises a second portion distal to the first portion, the second portion extending in a direction perpendicular to the first portion.

6. The closure cap as claimed in claim 1, wherein the second injection part has an outwardly directed annular shoulder, which is closed with a break-off part attached to the annular shoulder of the second injection part via an annular break zone.

7. The closure cap as claimed in claim 6, wherein the break-off part of the second injection part has a lateral grip tab, which extends across the outer portion of the lid part.

8. The closure cap as claimed in claim 7, wherein the lateral grip tab further comprises a second portion distal to the first portion, the second portion extending in a direction perpendicular to the first portion.

9. The closure cap as claimed in claim 1, wherein the closure part of the first injection part and/or the closure part of the second injection part and/or the closure part of the withdrawal part has an inwardly projecting edge, which fixes and clamps the self-sealing membrane of the closure part of the first and second injection parts and of the withdrawal part in the recess.

10. The closure cap as claimed in claim 1, wherein the recess of the first and second injection parts in each case has a first cylindrical upper portion and, adjoining the first cylindrical portion, a second cylindrical lower portion, wherein the second cylindrical portion has a greater diameter than the first cylindrical portion.

11. The closure cap as claimed in claim 10, wherein the self-sealing membrane of the first injection part has an annular lower portion, which is arranged in the second cylindrical portion of the recess, and a plate-shaped upper portion, which adjoins the annular portion via a central web and is arranged in the first cylindrical portion.

12. The closure cap as claimed in claim 1, wherein the self-sealing membrane of the first injection part has a cup-shaped depression.

13. The closure cap as claimed in claim 1, wherein the self-sealing membrane of the withdrawal part has an outer annular upper portion, to which a plate-shaped lower portion is adjoined via a central web, wherein the outer annular portion of the membrane is held with a clamping action.

14. The closure cap as claimed in claim 1, wherein the connector part of the withdrawal part is closed with a break-off part, which is attached to the connector part of the withdrawal part via an annular break-off zone.

15. The closure cap as claimed in claim 14, wherein the break-off part of the withdrawal part has a lateral grip tab, which extends across the outer portion of the lid part.

16. The closure cap of claim 1, wherein the first injection part is disposed between the second injection part and the withdrawal part.

17. The closure cap as claimed in claim 1, wherein the closure cap comprises at most one withdrawal part.

18. A receptacle for receiving medical liquids, including infusion or transfusion solutions or liquids for enteral nutrition, the receptacle comprising:

a bottle; and a closure cap with a withdrawal part for withdrawing the medical liquid using a spike, wherein the withdrawal part has an outwardly directed connector part, with a recess for receiving the spike, and an inwardly directed closure part, in which a self-sealing membrane is arranged with which the recess of the withdrawal part is closed, and a first injection part separate from the withdrawal part and designed for injecting an additive into the medical liquid using a needleless injection syringe, wherein the first injection part has an outwardly directed connector part, with a recess for receiving the conical stem of the syringe, and an inwardly directed closure part, in which a self-sealing membrane is arranged with which the recess of the first injection part is closed, wherein the closure cap has a second injection part separate from the first injection part and designed for injecting an additive into the medical liquid using an injection syringe that has a needle, wherein the second injection part has an inwardly directed closure part, with a recess in which a self-sealing membrane is arranged with which the recess of the closure part is closed wherein the closure cap has a lid part, wherein the lid part has an inner portion and an outer portion protruding outward from the inner portion and wherein the first and second injection parts and the withdrawal part are arranged lying next to one another in a row on the outer portion of the lid part.

19. An apparatus comprising a closure cap for closing a receptacle that contains a liquid, wherein said closure cap comprises a withdrawal part, a first injection part, a second injection part, and a lid part, wherein the withdrawal part is configured to permit withdrawal of said liquid using a spike, wherein the withdrawal part comprises an outwardly directed connector part, an inwardly directed closure part, recess, and a self-sealing membrane, wherein the recess is disposed in the outwardly directed connector part, wherein the recess is configured for receiving the spike, wherein the membrane is arranged in the inwardly directed closure part, and wherein the membrane closes the recess, wherein the first injection part is configured to receive, from a needleless injection syringe having a conical stem, an injection of an additive into the medical liquid, wherein the first injection part comprises an outwardly directed connector part, a recess, an inwardly directed closure part, and a self-sealing membrane, wherein the recess is disposed in the first injection part, wherein the recess is configured for receiving the conical stem of the syringe, wherein the self-sealing membrane is arranged in the inwardly directed closure part, wherein the membrane closes the recess of the first injection part, wherein the second injection part is configured to receive, from an injection syringe that has a needle, an injection of an additive into the liquid, wherein the second injection part comprises an inwardly directed closure part, a recess, and a self-sealing membrane, wherein the recess is disposed in the inwardly directed closure part, wherein the self-sealing membrane is disposed in the recess, and wherein the membrane closes the recess, wherein the lid part comprises an inner portion, an outer portion, and a row, wherein the outer portion protrudes outward from the inner portion, wherein the row is on the outer portion, wherein the first injection part, the second injection part, and the withdrawal part lie next to one another along the row, wherein the withdrawal part, the first injection part, and the second injection part are all separate from each other, and wherein the liquid is selected from the group consisting of a medical liquid, an infusion solution, a transfusion solution, and an enteral feeding solution.

* * * * *